US007122758B2

(12) United States Patent
Schweizer et al.

(10) Patent No.: US 7,122,758 B2
(45) Date of Patent: Oct. 17, 2006

(54) INSULATED EARTHING SWITCH FOR GAS-INSULATED SWITCHGEAR ASSEMBLIES

(75) Inventors: Christoph Schweizer, Regensdorf (CH); Diego Sologuren-Sanchez, Wettingen (CH); Erwin Manz, Lauchringen (DE); Walter Holaus, Zurich (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/066,150

(22) Filed: Feb. 25, 2005

(65) Prior Publication Data

US 2005/0189325 A1 Sep. 1, 2005

(30) Foreign Application Priority Data

Feb. 27, 2004 (EP) ..... 04405117

(51) Int. Cl.
*H01H 33/70* (2006.01)

(52) U.S. Cl. ..... 218/79; 218/68

(58) Field of Classification Search ..... 218/55, 218/65, 67, 68, 79, 80, 2, 7, 12, 14, 43, 45, 218/46, 78, 84, 153–156
See application file for complete search history.

(56) References Cited

U.S. PATENT DOCUMENTS 3,553,397 A * 1/1971 Schmitz ..... 200/48 R
3,876,846 A * 4/1975 Graybill ..... 218/68
6,759,616 B1 * 7/2004 Rokunohe et al. ..... 218/2

FOREIGN PATENT DOCUMENTS

EP 0196240 A2 * 10/1986
WO 99/52119 10/1999
WO WO 9962154 A1 * 12/1999

OTHER PUBLICATIONS

Mamoru Okabe et al., "Serialization of Standard Gas Insulated Switchgear", Hitachi Review, vol. 51, No. 5, 2002, pp. 169-173.

* cited by examiner

*Primary Examiner*—Elvin Enad
*Assistant Examiner*—M. Fishman
(74) *Attorney, Agent, or Firm*—Buchanan Ingersoll & Rooney PC

(57) ABSTRACT

An insulated earthing switch for encapsulated, gas-insulated high-voltage switchgear assemblies is characterized in that an encapsulation-side earthing switch contact, a measuring electrode and an earthing switch housing are arranged altogether on a single earthing switch mounting side, and an encapsulation-side earthing switch contact and the measuring electrode are electrically insulated with respect to the earthing switch housing and the GIS housing. Exemplary embodiments contains an encapsulation-side earthing switch contact and a measuring electrode being electrically insulated from drive cables and drive rods; an encapsulation-side earthing switch contact in the form of a movable earthing switch contact or an earthing switch fixed contact; and an earthing switch housing being permanently electrically conductively connected to the GIS housing via a combined supporting and measuring flange.

14 Claims, 4 Drawing Sheets

INSULATED EARTHING SWITCH FOR GAS-INSULATED SWITCHGEAR ASSEMBLIES

TECHNICAL FIELD

The invention relates to the field of high-voltage technology, in particular to electrical insulation and connection technology for gas-insulated switchgear assemblies (GIS) at ground potential. It is based on an earthing switching device and a gas-insulated switch-gear assembly in accordance with the preamble of the independent patent claims.

PRIOR ART

Earthing switches in existing gas-insulated switchgear assemblies may be in the form of so-called "insulated earthing switches". With these variants, the earthing switch housing is separated from the remaining housings of the gas-insulated switchgear assembly (GIS) by an insulating intermediate flange. During normal operation, this insulating flange is bridged by a solid ground connection. For measurements in which a measured signal is applied to or is tapped off over the contact system of the earth switch, this bridging is removed.

Such an insulated earthing switch is disclosed in the article by M. Okabe et al., "Serialization of Standard Gas Insulated Switchgear", Hitachi Review Vol. 51 (2002), No. 5. The invention relates to this prior art. In that document, a conventional, combined disconnector/earthing switch or three-position switch is shown in which a movable contact piece can be moved by means of a linear movement between the positions "disconnector connected", i.e. disconnector contact closed, "disconnector disconnected", i.e. disconnector contact open and "earthing switch connected", i.e. earthing switch contact closed in addition. The earthing switch fixed contact is mounted on a flat hood of the gas-insulated switchgear assembly (GIS) on the inner side of the hood. The earthing switch fixed contact is guided out of the GIS housing in an electrically insulated manner and can be short-circuited with the GIS housing on the outside via a contact bridge.

EP 1 068 624 B1 also discloses a combined disconnector/earthing switch. In this case, the earthing switch fixed contact is in the form of a pin-like contact piece which is mounted on a contact support, which on its part is held on a bolt that is passed to the outside through the GIS housing wall and is electrically insulated from the GIS housing wall.

SUMMARY OF THE INVENTION

The object of the present invention is to specify an improved insulated earthing switch for gas-insulated switchgear assemblies. This object is achieved according to the invention by the features of the independent claims.

The invention consists in an earthing switch, in particular for gas-insulated, encapsulated high-voltage switchgear assemblies, comprising an encapsulation-side earthing switch contact, an inner earthing switch contact and an earthing switch housing, which serves for the purpose of accommodating an earthing switch drive and which is mechanically connected to a GIS housing of the gas-insulated switchgear assembly on an earthing switch mounting side of the gas-insulated switchgear assembly, an electrically insulated measuring electrode being provided for the purpose of making electrical contact with the encapsulation-side earthing switch contact from the outside, wherein further the encapsulation-side earthing switch contact, the measuring electrode and the earthing switch housing are altogether commonly arranged on the earthing switch mounting side, and the encapsulation-side earthing switch contact and the measuring electrode are electrically insulated from the earthing switch housing and the GIS housing. The earthing switch is thus arranged completely, including the drive and the measuring tap, on only one side or mounting face of the GIS encapsulation and is accessible from this side. The earthing switch housing serves for the purpose of accommodating components of the earthing switch and typically accommodates the earthing switch drive. At least one of the earthing switch contacts is a movable earthing switch contact. The invention makes possible a very simple means of mounting and accessing the earthing switch and makes it possible to arrange and operate the measuring electrode in a very simple manner for electrical measurements on active parts from the same side. This allows also to achieve a very compact design of the earthing switch.

In a first exemplary embodiment, the measuring electrode or the measuring tap is passed through the GIS housing or the earthing switch housing to the outside in an electrically insulated manner and/or it can be short-circuited with the GIS housing and/or the earthing switch housing by means of a ground connection that can be mounted from the outside. The measuring tap is thus installed permanently for the purpose of making electrical contact with and passing the encapsulation-side earthing switch contact through the GIS housing or earthing switch housing. This entails only little additional costs. This solution dispenses with a special, expensive insulating flange having bolts which are cast in on both sides in a complex manner, which had previously to be mounted for measuring purposes, if needed, between the GIS housing and the earthing switch housing. The previous different types of insulated and not insulated earthing switches can now be made with an identical design. If all the earthing switches are made of insulated design, measurements may also be carried out at different points in the GIS assembly, and can thus deliver more meaningful results.

In a further exemplary embodiment, the encapsulation-side earthing switch contact and the measuring electrode are electrically insulated with respect to the earthing switch drive and/or with respect to possibly present electrical connections for the earthing switch drive and/or with respect to neighbouring phases, in particular with respect to possibly present drive rods to neighbouring phases. This simplifies electrical measurements, because only the ground connection must be removed, but no other elements, such as drive cables or drive rods to neighbouring phases in switchgear assemblies having three-phase or single-phase encapsulation.

The exemplary embodiment as claimed in claim 4 has the advantage that it is irrelevant for the purposes of the invention, whether the encapsulation-side earthing switch contact is a movable earthing switch contact or a fixed contact. The invention can thus be used for any arbitrary type of earthing switch independently of whether the movable earthing switch contact can be moved from the inside outwards, i.e. towards the encapsulation wall, or from the outside inwards.

The exemplary embodiment as claimed in claim 5 has the advantage that the earthing switch is supported as a whole on a single flange, which at the same time bears the earthing switch housing (supporting flange) and has a separate access for the measuring electrode (measuring flange). This arrangement is particularly space-saving.

Claims 6–7. relate to exemplary embodiments of an earthing switch and, in particular, a fast-acting earthing switch, in which the supporting flange and the measuring flange are arranged orthogonally with respect to one another.

Claim 10 relates to an electrical switchgear assembly comprising an earthing switch, as described above, and having the advantages mentioned there.

Further embodiments, advantages and applications of the invention are given in the dependent claims as well as in the description below and the figures.

BRIEF DESCRIPTION OF THE DRAWINGS

In the figures the same parts are provided with the same references.

Ways of Implementing the Invention

Figure 1B:
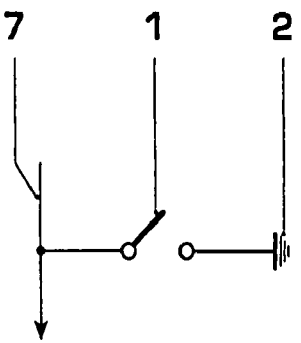
FIGS. 1*a*, 1*b* show schematic illustrations in cross section of a not insulated earthing switch according to prior art (FIG. 1*a*) with an associated circuit diagram (FIG. 1*b*)
Figure 1A:
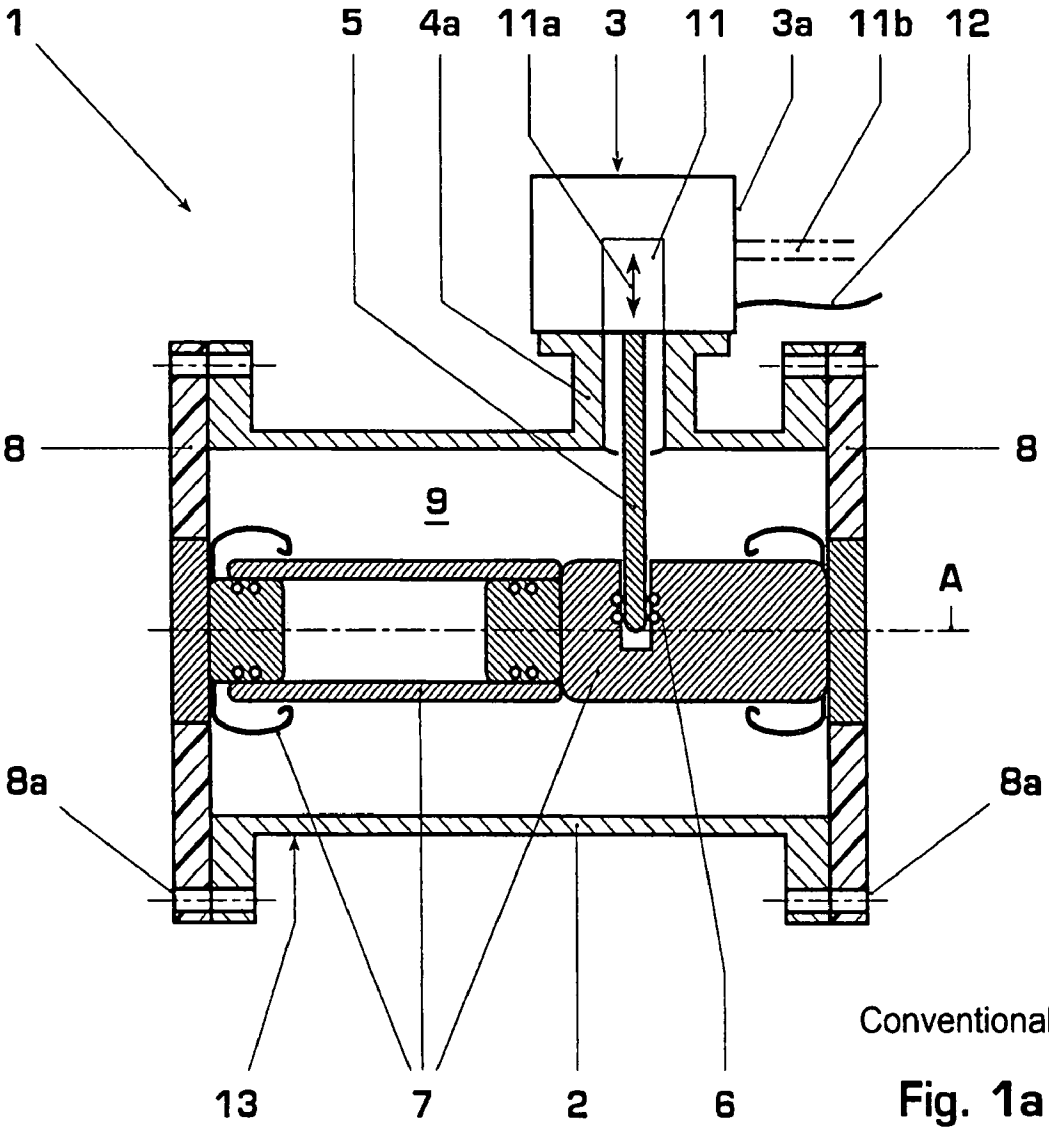
Conventional Art Fig. 1a

FIG. 1*a* shows a conventional, not insulated earthing switch 1 in an encapsulated, gas-insulated switchgear assembly 13. The housing 2 of the gas-insulated switchgear assembly 13 encloses a gas chamber 9, which is preferably filled with $SF_6$ gas under a few bars of pressure. The earthing switch fitting 3 with its earthing switch housing 3*a* is fixed to the GIS housing 2 via a mounting flange 4*a*. A movable earthing switch contact pin 5 is moved towards the earthing switch fixed contact 6 along a drive movement 11*a* by the earthing switch drive 11, which is typically arranged in the earthing switch housing 3*a*, in order to ground active parts 7 of the encapsulated gas-insulated switchgear assembly 13. During normal operation of the switchgear assembly 13, the contact pin 5 is withdrawn, and the active parts 7 are subjected to a high voltage and/or carry the operating current or short-circuit current. The active parts or current conductors 7 are held in the gas-filled interior 9 of the encapsulation 2 by insulators 8, in particular post insulators 8 and partition insulators 8. The insulators 8 are themselves supported on the GIS encapsulation 2 by means of insulator flanges 8*a*. The longitudinal axis of the not insulated fast-acting earthing switch 1 is designated with the reference numeral A.

FIG. 1*b* shows the circuit diagram of the not insulated switching device 1, according to which the ground potential is defined by the GIS housing 2, and the entire device 1 including the earthing switch housing 3*a* and the earthing switch contact pin 5 and contact 6, is electrically connected to ground potential in the case of grounding. The earthing switch housing 3*a* or the earthing switch fitting 3 are additionally electrically connected to the exterior environment via drive lines 12 and/or drive rods 11*b*.

Figure 2B:
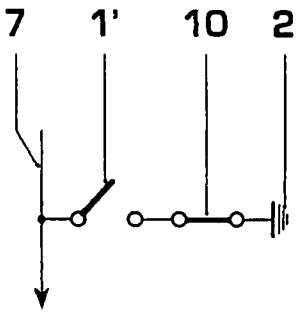
FIGS. 2*a*–2*c* show schematic illustrations in cross section of an insulated earthing switch according to prior art (FIG. 2*a*) with an associated circuit diagram (FIGS. 2*b*, 2*c*)
Figure 2C:
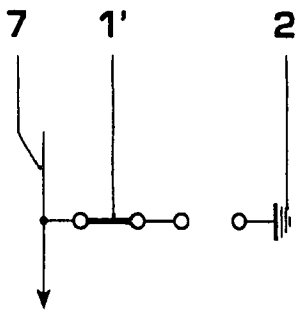
Figure 2A:
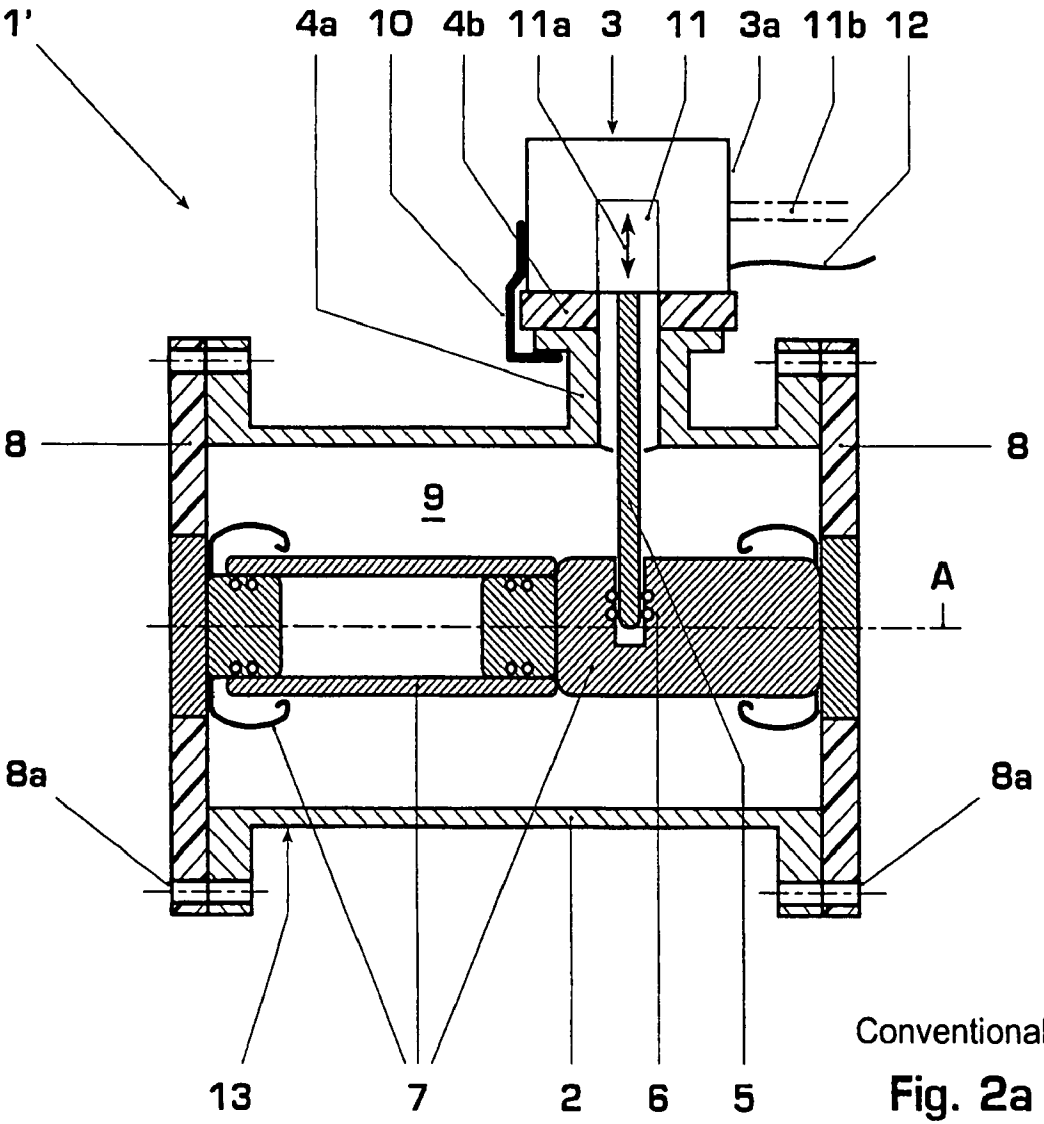
Conventional Art Fig. 2a

FIG. 2*a* shows the earthing switch or the fast-acting earthing switch 1' as above, but in an insulated embodiment. For this purpose, the earthing switch fitting 3 with the earthing switch housing 3*a* is electrically insulated from the GIS housing 2 by means of an insulating intermediate flange 4*b*. During normal operation, the intermediate flange 4*b* is bridged by a grounding bracket or bar or bridge 10, which short-circuits the earthing switch housing 3*a* with the GIS housing 2. If the intention is to perform electrical measurements, the bracket 10 is removed, and the earthing switch housing 3*a* acts as a measuring electrode. Therefore, also other electrical connections to the earthing switch housing 3*a*, in particular electrical connections 12 and drive rods 11*b*, must be removed. This is cumbersome and requires a lot of work.

FIG. 2*b* and FIG. 2*c* show the circuit diagram of the insulated earthing switch 1' during normal operation and, respectively, in the event of electrical measure-ments at active parts 7 of the switchgear assembly 13 when grounded. With the bracket 10 removed, the grounding is thus removed, and the measurements can be made.

In most embodiments of current earthing switches 1, 1', the movable contact 5 is moved inwards towards the active parts 7 from the outside, i.e. from the encapsulation 2. The earthing switch fixed contact 6 is typically integrated in the active parts 7 in the inner tube. Known earthing switches 1 or 1' are mounted on suitable flanges 4*a* in the switchgear assemblies 13. These flanges 4*a* are either standard flanges, which are used for every connection, or smaller flanges, which are specially designed for fitting the earthing switches 1, 1'.

Figure 3:
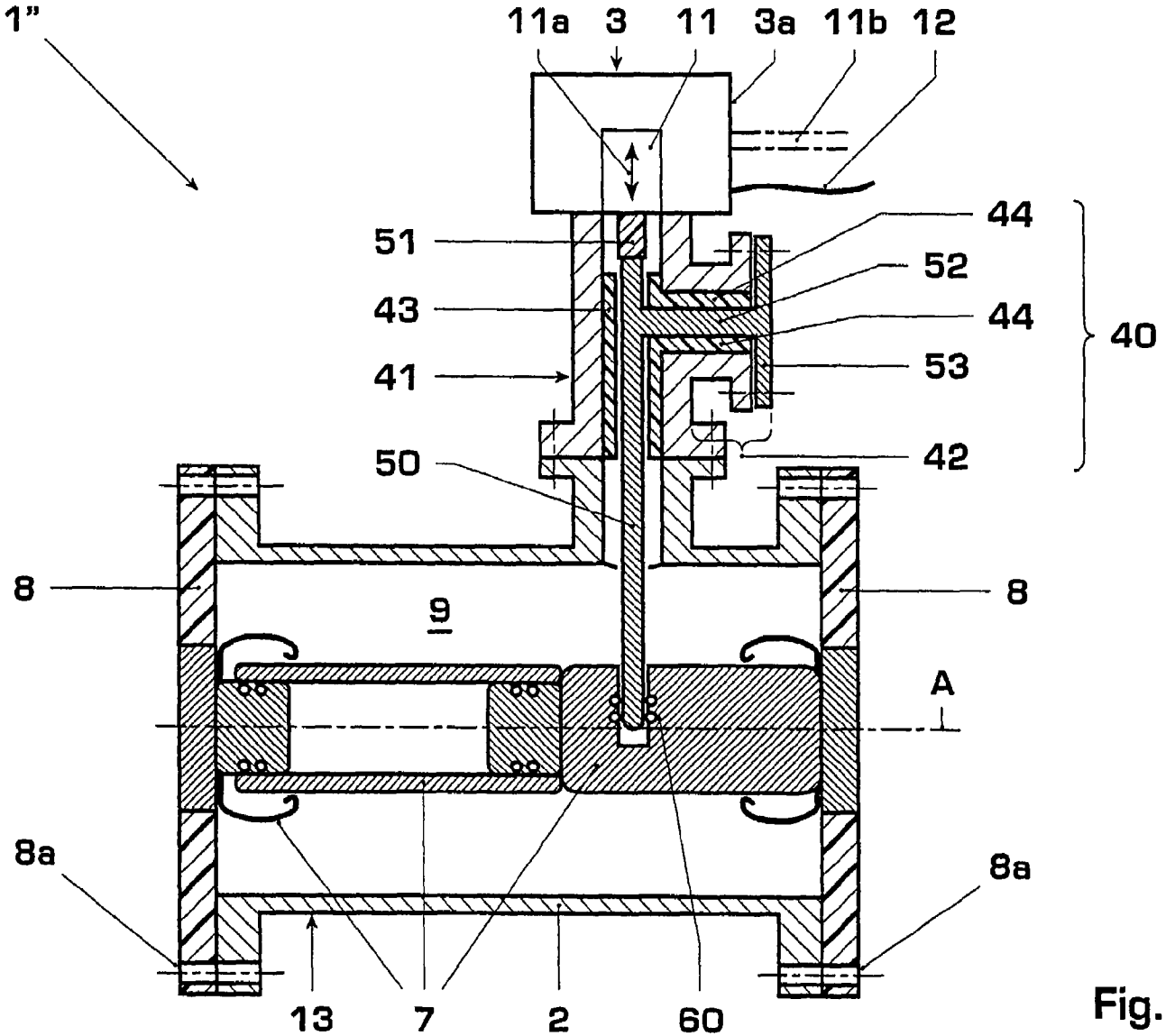
FIG. 3 shows a schematic illustration in cross section of an exemplary embodiment of a separate earthing switch having an insulated earthing switch pin according to invention.
Figure 4:
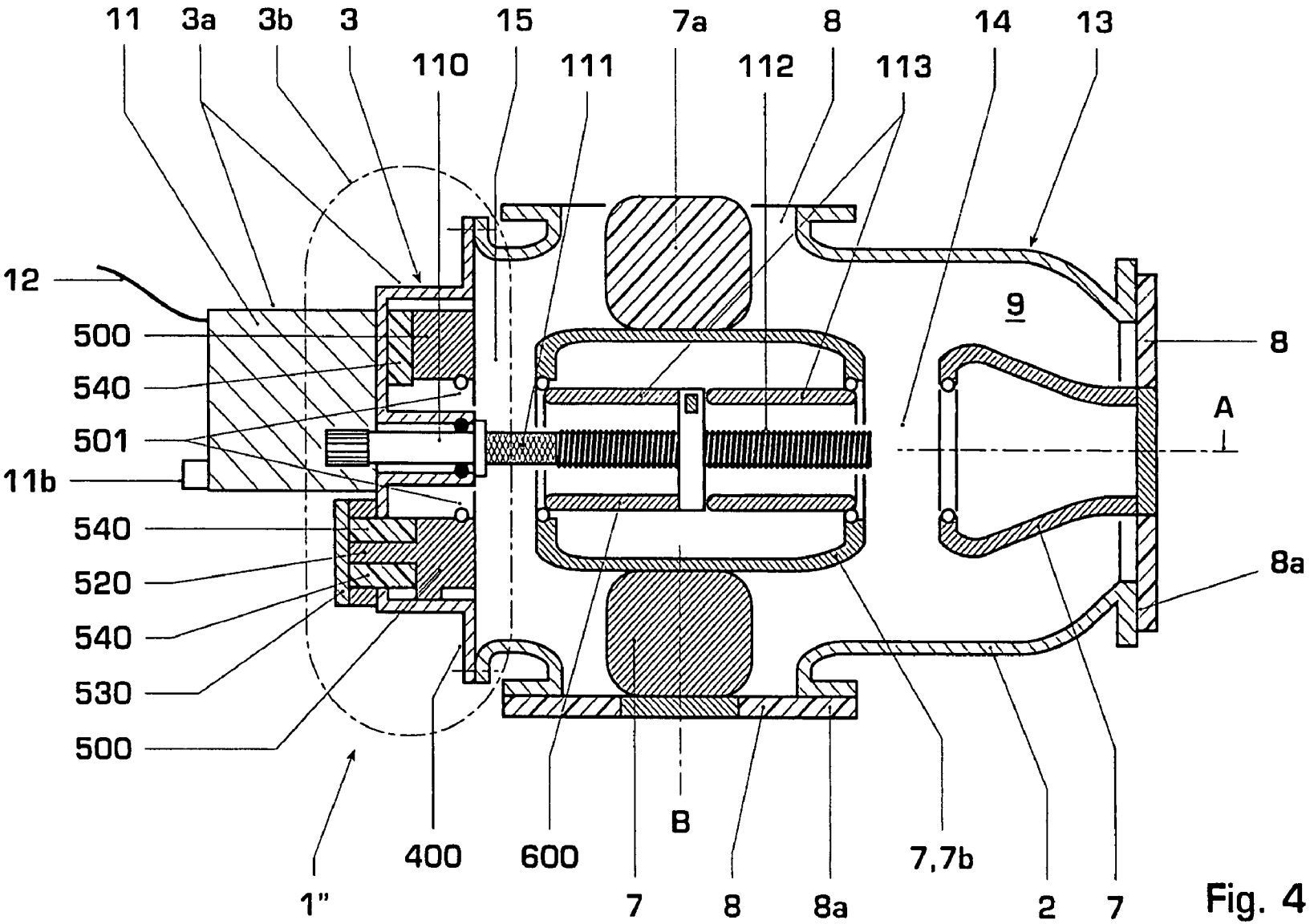
FIG. 4 shows a schematic illustration in cross section of an exemplary embodiment of a combined disconnector/earthing switch having an earthing switch fixed contact being insulated according to invention.

FIG. 3 shows a first and FIG. 4 a second exemplary embodiment of the invention. The earthing switch 1" comprises an encapsulation-side earthing switch contact 50, 51; 500, an inner earthing switch contact 60; 600 and an earthing switch housing 3*a*, which serves the purpose of accommodating the earthing switch drive 11 and which is mechanically connected to the GIS housing 2 of the gas-insulated switchgear assembly 13 on an earthing switch mounting side 3*b* of the gas-insulated switchgear assembly 13, wherein an electrically insulated measuring electrode 52, 520 is present for the purpose of making electrical contact with the encapsulation-side earthing switch contact 50, 51; 500 from the outside. In accordance with the invention, in the earthing switch 1" the encapsulation-side earthing switch contact 50, 51; 500, the measuring electrode 52, 520 and the earthing switch housing 3*a* are altogether arranged commonly on the same earthing switch mounting side 3*b*, and the encapsulation-side earthing switch contact 50, 51; 500 and the measuring electrode 52, 520 are electrically insulated with respect to the earthing switch housing 3*a* and the GIS housing 2. In the following, exemplary embodiments are specified below.

Advantageously, the encapsulation-side earthing switch contact 50, 51; 500 and the measuring electrode 52, 520 are electrically insulated from the earthing switch drive 11 and/or from possibly present electrical connections 12 for the earthing switch drive 11 and/or from neighbouring phases, in particular from possibly present drive rods 11*b* to neighbouring phases. Preferably, the ground connection 53, 530 is a ground connection bar or bracket 53, 530, which can be mounted on the measuring flange 42 or the earthing switch housing 3*a* and which, when mounted, electrically short-circuits the measuring electrode 52, 520 with the measuring flange 42 or the earthing switch housing 3*a*. Electrical measurements are thus simplified, since, apart from the ground connection 53, 530, no other electrical contacts to the earthing switch housing 3*a* must be interrupted. This simple handling improves safety for personnel during measurements.

An earthing switch fitting 3, enclosed by the earthing switch housing 3*a*, can mechanically be connected to the GIS housing 2 by means of a combined supporting and measuring flange 40; 41, 42; 400 on the earthing switch mounting side 3*b*. Preferably, the earthing switch housing 3*a*, the combined supporting and measuring flange 40; 41, 42; 400 and the GIS housing 2 are electrically conductively connected to one another. The earthing switch housing 3*a* is thus always directly connected to the GIS housing 2 and does not require an insulating intermediate flange.

In accordance with FIG. 3, the encapsulation-side earthing switch contact is a movable earthing switch contact 50, 51 and comprises an earthing switch contact pin 50, which is electrically insulated from the earthing switch drive 11 by means of an insulating switching rod 51 and which can be driven by the insulating switching rod 51. Only the contact pin 50 and not the entire earthing switch 1" is thus insulated. The inner earthing switch contact is in this case in the form of an earthing switch fixed contact 60. The combined supporting and measuring flange 40; 41, 42 can, as illustrated, have a supporting flange 41, which extends along the movable earthing switch contact 50, 51, and a measuring flange 42, which is fitted laterally on the supporting flange 41, for the purpose of accommodating and passing through the measuring electrode 52. The lateral access point to the contact pin 50, which is of insulated design, is electrically conductively connected to the GIS housing 2 using a ground connection 53. This connection 53 is fitted during normal operation and creates the contact between the earthing switch contact pin 50 and the GIS housing 2 as well as, if necessary, the earthing switch housing 3*a*. For measurements in which a measured signal is applied to the earthing switch contact system or is tapped off by means of said earthing switch contact system, only the ground connection 53 needs to be removed without further work on the drive 11, its wiring 12 or its rod or rods 11*b* being required.

A dielectric insulation 43 can be arranged in the interior of the supporting flange 41 for the purpose of electrically insulating the supporting flange 41 from the movable earthing switch contact 50, 51, in particular from the earthing switch contact pin 50. In addition, a dielectric insulation 44 may also be provided in the interior of the measuring flange 42 for the purpose of electrically insulating the measuring flange 42 from the measuring electrode 52.

FIG. 4 shows a second embodiment of the invention. This is illustrated by way of example with reference to a combined disconnector/earthing switch 1". The insulating path 14 and the grounding path 15 are in this case arranged, by way of example, in series behind one another. The active parts 7 also comprise, in addition to the current conductors 7, a holder 7*a*, which may optionally be in the form of a current connection 7*a* along the transverse axis B, and a shield 7*b* for the movable contact tube 113 of the disconnector/earthing switch. Again, an earthing switch drive 11, a movable earthing switch contact 600 and an earthing switch fixed contact 500 are present. The combined disconnector/earthing switch drive, shown here by way of example, comprises, in addition to the motor unit 11, a drive shaft 110, an insulating shaft 111 and a spindle 112 for the purpose of driving the contact tube 113 and, in particular, the movable earthing switch contact 600.

As shown in FIG. 4, the encapsulation-side earthing switch contact is thus in the form of an earthing switch fixed contact 500, which is electrically insulated from the earthing switch housing 3*a* by means of a dielectric insulation 540, and the inner earthing switch contact is the movable earthing switch contact tube 600. The movable earthing switch contact 600 and the earthing switch fixed contact 500 are arranged in the gas chamber 9 of the gas-insulated switchgear assembly 13. The earthing switch fixed contact 500 has typically a contact system 501, for example helical springs or the like.

Mounting the earthing switch 1", including the earthing switch housing 3*a*, the drive 11 and the insulated measuring tap 52, 520, on a single earthing switch mounting side 3*b*, namely in a radial position (FIG. 3) or, at the end, in an axial position (FIG. 4) on the GIS housing 2, results in a very compact design and, at the same time, in simple operability of the measuring tap 53, 530. This is true for switchgear assemblies 13 having single-phase or three-phase encapsulation.

The earthing switch 1' is particularly suitable for gas-insulated medium- or high-voltage switchgear assemblies 13. Also claimed is a switchgear assembly 13 having such an earthing switch 1'.

LIST OF REFERENCES

1 Conventional, not insulated earthing switch
1' conventional, insulated earthing switch
1" insulated earthing switch according to the invention
2 GIS housing
3 Earthing switch fitting with earthing switch drive
3*a* earthing switch housing
3*b* earthing switch mounting side
4*a* flange for earthing switch fitting, mounting flange, supporting flange (prior art)
4*b* Intermediate flange for earthing switch fitting, insulating flange (prior art)
40, 400 combined supporting and measuring flange for earthing switch fitting, earthing switch flange having measuring tap
41 Extended supporting flange
42 Measuring flange, measuring bushing for earthing switch contact pin
43 Insulation between supporting flange and contact pin
44 Insulation between measuring flange and measuring electrode
5 movable earthing switch contact pin
50 housing-side earthing switch contact, movable insulated earthing switch contact pin
51 Insulating switching rod for earthing switch contact pin
52 Measuring electrode, lateral measuring tap at earthing switch contact pin
53 Ground connection for measuring electrode, removable contact pin grounding bar
500 Housing-side earthing switch contact, earthing switch fixed contact integrated in mounting hood
501 Contact system
520 Measuring electrode, axial measuring tap at earthing switch fixed contact
530 Ground connection for measuring electrode, removable fixed contact grounding bracket
540 Insulation between earthing switch housing and earthing switch fixed contact
6 Earthing switch fixed contact
60 Inner earthing switch contact, earthing switch fixed contact
600 Inner earthing switch contact, movable earthing switch contact tube
7 Active parts of the switchgear assembly, current conductor (at high-voltage potential)
7*a* Holder, optional current connection
7*b* Shield for movable contact tube

8 Insulator, post insulator, partition insulator
8*a* Insulator flange
9 Gas chamber, $SF_6$
10 Ground connection, grounding bracket
11 Earthing switch drive
11*a* Drive movement
11*b* Drive rods to neighbouring phases
110 Drive shaft
111 Insulating shaft
112 Spindle
113 Contact tube
12 Electrical connections
13 Gas-insulated switchgear assembly (GIS)
14 Isolating path
15 Grounding path
A Axis of the switchgear assembly section, longitudinal axis
B Transverse axis

The invention claimed is:

1. An earthing switch, comprising an encapsulation-side earthing switch contact, an inner earthing switch contact and an earthing switch housing for accommodating an earthing switch drive and which is mechanically connected to a gas insulated switchgear (GIS) housing of the gas-insulated switchgear assembly on an earthing switch mounting side of the gas-insulated switchgear assembly, an electrically insulated measuring electrode being provided for making electrical contact with the encapsulation-side earthing switch contact from the outside, wherein a) the encapsulation-side earthing switch contact, the measuring electrode and the earthing switch housing are arranged commonly on the earthing switch mounting side, and b) the encapsulation-side earthing switch contact and the measuring electrode are electrically insulated against the earthing switch housing and the GIS housing, wherein the encapsulation-side earthing switch contact is an earthing switch fixed contact, that is electrically insulated from the earthing switch housing by means of a dielectric insulation, and the inner earthing switch contact is a movable earthing switch contact tube.

2. The earthing switch as claimed in claim 1, wherein the measuring electrode a) is passed through the GIS housing or the earthing switch housing to the outside in an electrically insulated manner, and/or b) can be short-circuited with the GIS housing and/or the earthing switch housing by means of a ground connection that can be mounted from the outside.

3. The earthing switch as claimed in claim 1, wherein the encapsulation-side earthing switch contact and the measuring electrode are electrically insulated with respect to the earthing switch drive and/or with respect to possibly present electrical connections for the earthing switch drive and/or with respect to neighbouring phases.

4. The earthing switch as claimed in claim 1, wherein an earthing switch fitting, enclosed by the earthing switch housing, is mechanically connected to the GIS housing on the earthing switch mounting side by means of a combined supporting and measuring flange.

5. The earthing switch as claimed in claim 4, wherein the combined supporting and measuring flange has a supporting flange, which extends along the movable earthing switch contact, and a measuring flange, which is fitted laterally on the supporting flange, accommodating and passing through the measuring electrode.

6. The earthing switch as claimed in claim 5, wherein a) a dielectric insulation is provided in the interior of the supporting flange for electrically insulating the supporting flange from the movable earthing switch contact, and/or b) a dielectric insulation is provided in the interior of the measuring flange for electrically insulating the measuring flange from the measuring electrode.

7. The earthing switch as claimed in claim 1, wherein the ground connection is a ground connection bracket, which can be mounted on the measuring flange or the earthing switch housing and which, when mounted, electrically short-circuits the measuring electrode with the measuring flange or the earthing switch housing.

8. The earthing switch as claimed in claim 1, wherein the earthing switch is designed for a switchgear assembly having single-phase or three-phase encapsulation.

9. An electrical switchgear assembly, having an earthing switch as claimed in claim 1.

10. The earthing switch as claimed in claim 1, wherein the earthing switch is for gas-insulated, encapsulated high-voltage switchgear assemblies.

11. The earthing switch as claimed in claim 4, wherein the earthing switch housing, the combined supporting and measuring flange and the GIS housing are electrically conductively connected to one another.

12. The earthing switch as claimed in claim 8, wherein the earthing switch is in the form of a separate earthing switch.

13. The earthing switch as claimed in claim 8, wherein the earthing switch is part of a combined disconnector/ earthing switch.

14. The earthing switch as claimed in claim 13, wherein the earthing switch is equipped with a common disconnector/earthing switch drive.

* * * * *